US005513522A

United States Patent [19]

Seki et al.

[11] Patent Number: 5,513,522

[45] Date of Patent: May 7, 1996

[54] ABNORMALITY-DETECTING DEVICE FOR EXHAUST GAS COMPONENT CONCENTRATION SENSOR OF INTERNAL COMBUSTION ENGINE

[75] Inventors: Yasunari Seki; Masataka Chikamatsu, both of Wako, Japan

[73] Assignee: Honda Giken Kogyo Kabushiki Kaisha, Tokyo, Japan

[21] Appl. No.: 405,518

[22] Filed: Mar. 16, 1995

[30] Foreign Application Priority Data

Mar. 18, 1994 [JP] Japan ..... 6-73913

[51] Int. Cl.[6] ..... F02D 41/14

[52] U.S. Cl. ..... 73/118.1; 73/23.31

[58] Field of Search ..... 73/116, 117.2, 73/117.3, 118.1, 118.2, 23.31, 23.32

[56] References Cited

U.S. PATENT DOCUMENTS

| | | | |
|---|---|---|---|
| 4,388,821 | 6/1983 | Martinez et al. | 73/116 |
| 4,389,881 | 6/1983 | Butter et al. | 73/116 |
| 4,570,479 | 2/1986 | Sakurai et al. | 73/116 |
| 4,638,658 | 1/1987 | Otobe | 73/117.3 |
| 4,712,419 | 12/1987 | Ikai et al. | 73/116 |
| 5,010,762 | 4/1991 | Logothetis et al. | 73/116 |
| 5,089,113 | 2/1992 | Logothetis et al. | 73/116 |
| 5,228,335 | 7/1993 | Clemmens et al. | 73/118.1 |
| 5,325,711 | 7/1994 | Hamburg et al. | 73/118.1 |
| 5,327,780 | 7/1994 | Entenmann et al. | 73/118.1 |
| 5,390,650 | 2/1995 | Gee et al. | 73/118.1 |

FOREIGN PATENT DOCUMENTS 4-233447 8/1992 Japan .

*Primary Examiner*—Richard Chilcot
*Assistant Examiner*—George M. Dombroke
*Attorney, Agent, or Firm*—Nikaido, Marmelstein, Murray & Oram

[57] ABSTRACT

An abnormality-detecting device for an exhaust gas component concentration sensor arranged in the exhaust system of an internal combustion engine detects abnormality of the exhaust gas component concentration sensor, based on an amount of change in an output from the exhaust gas component concentration sensor exhibited when a predetermined voltage is applied thereto. The abnormality-detecting device defers determination of abnormality of the exhaust gas component concentration sensor until the engine reaches a predetermined operating condition after the engine is started.

27 Claims, 15 Drawing Sheets

CATALYTIC CONVERTER
14
17
17a
16
16a
13
1
INTERNAL COMBUSTION ENGINE
11
NE
TW
10
12
IG
6
FUEL INJECTION VALVE
2
TA
9
7
8
PBA
3
θTH
4
5a
5b
5c
5d
INPUT CIRCUIT
C P U
MEMORY MEANS
OUTPUT CIRCUIT
ECU
5

| LOAD REGION / ESTIMATED TEMPERATURE REGION | F/C IDLING LS | A | B | C | D |
|---|---|---|---|---|---|
| Ⅲ | −r0 | −rA | −rB | HOLD | +rD |
| Ⅱ | −β0 | −βA | HOLD | +βC | +βD |
| Ⅰ | −α0 | HOLD | +αB | +αC | +αD |

ABNORMALITY-DETECTING DEVICE FOR EXHAUST GAS COMPONENT CONCENTRATION SENSOR OF INTERNAL COMBUSTION ENGINE

BACKGROUND OF THE INVENTION

1. Field of the Invention

This invention relates to an abnormality-detecting device for detecting abnormality of an exhaust gas component concentration sensor arranged in an exhaust system of an internal combustion engine.

2. Prior Art

Conventionally, an abnormality-detecting device for detecting abnormality of an exhaust gas component concentration sensor arranged in an exhaust system of the engine has been proposed by the present assignee e.g. in Japanese Laid-Open Patent Publication (Kokai) No. 4-233447, in which feeble current is caused to flow through the exhaust gas component concentration sensor to check an amount of change in the output therefrom, whereby it is determined from the detected amount of change in the sensor output whether there is an abnormality of the sensor, such as a disconnection and a short-circuit, or an abnormality due to aging or the like.

As shown in FIG. 16, a typical exhaust gas component concentration sensor of this kind is comprised of a sensor element 51 formed of a solid electrolyte of zirconia ($ZrO_2$) arranged within a casing 52. More specifically, the sensor element 51 in the form of a tube has inner and outer surfaces thereof coated with platinum as an electrode. Exhaust gases are introduced into a space 53 defined between the outer surface of the sensor element 51 and the casing 52, while fresh air as a reference gas is introduced into an inner space 54 defined by the inner surface of the sensor element 51. The sensor has a characteristic that an electromotive force thereof drastically changes as the air-fuel ratio of the exhaust gases changes across a stoichiometric air-fuel ratio, so that an output signal thereof is inverted in level from a leaner side to a richer side with respect to the stoichiometric air-fuel ratio and vice versa. More specifically, a high level output signal assumes when the air-fuel ratio is rich, and a low level when the same is lean.

Further, the exhaust gas component concentration sensor is provided with a heater 55 arranged in the inner space 54 of the sensor element 51 for accelerating the activation of the sensor.

However, in the exhaust gas component concentration sensor, when the exhaust system and the exhaust gas component concentration sensor are cold, e.g. when the engine is started in a cold condition, or when the ambient air is low in temperature and/or high in humidity, there can be formed water condensed from vapor contained in exhaust gases, which stays on the sensor element 51 and the casing 52 in a fashion bridging therebetween, as indicated by X in FIG. 16. This causes a drop in the electric resistance of the sensor element 51. As a result, when subtle current is caused to flow through the sensor element 51 with condensate water thereon, an apparent short-circuit is caused by the bridge of the condensed water, so that there occurs no change in output voltage of the sensor. This leads to detection of abnormality of the sensor. That is, in spite of the fact that when the engine has been warmed up, the condensed water evaporates to cancel the apparent short-circuit of the sensor element, to bring the sensor into a normally functioning state in which the sensor delivers a normal output voltage, the sensor is erroneously detected to be abnormal when the engine is started under the aforementioned environmental condition (cold condition).

SUMMARY OF THE INVENTION

It is an object of the invention to provide an abnormality-detecting device for detecting abnormality of an exhaust gas component concentration sensor of an internal combustion engine, which is free from erroneous detection of abnormality of the sensor when the engine is started under predetermined environmental conditions.

To attain the above object, the present invention provides an abnormality-detecting device for an exhaust gas component concentration sensor of an internal combustion engine, the engine having an exhaust system in which is arranged the exhaust gas component concentration sensor for detecting concentration of a component of exhaust gases emitted from the engine, the abnormality-detecting device including abnormality-detecting means for detecting abnormality of the exhaust gas component concentration sensor, based on an amount of change in an output from the exhaust gas component concentration sensor exhibited when a predetermined voltage is applied thereto.

The abnormality-detecting device according to the invention is characterized in that the abnormality-detecting means comprises normality-determining means for determining that the exhaust gas component concentration sensor is functioning normally when the amount of change in the output from the exhaust gas component concentration sensor exceeds a predetermined value, and abnormality determination-deferring means for deferring determination of abnormality of the exhaust gas component concentration sensor based on the amount of change in the output from the exhaust gas component concentration sensor, when the amount of change in the output assumes a value below the predetermined value before the engine reaches a predetermined operating condition after the engine is started.

Preferably, the predetermined operating condition of the engine at least includes a condition in which condensate of water formed within the exhaust gas component concentration sensor has evaporated.

More preferably, the abnormality determination-deferring means regards the exhaust gas component concentration sensor as inactive so long as the determination of abnormality of the exhaust gas component concentration sensor is deferred.

In one preferred embodiment, the abnormality-detecting device includes measuring means for measuring a time period elapsed after the engine is started, and operating condition-determining means for determining whether the engine has reached the predetermined operating condition, based on the time period measured by the measuring means.

Specifically, the predetermined operating condition of the engine is an operating condition in which the time period elapsed after the engine is started has reached a predetermined time period.

In another preferred embodiment, the engine includes a catalytic converter arranged in the exhaust system, and the abnormality-detecting device includes operating condition-determining means for determining whether the engine has reached the predetermined operating condition, based on a catalyst bed temperature of the catalytic converter.

Preferably, the predetermined operating condition of the engine is an operating condition in which the catalyst bed temperature is above a predetermined value.

More preferably, the abnormality-detecting device includes engine speed-detecting means for detecting rotational speed of the engine, load-detecting means for detecting load on the engine, load region-determining means for determining a load region in which the engine is operating, based on results of detection by the engine speed-detecting means and the load-detecting means, and catalyst bed temperature-estimating means for estimating the catalyst bed temperature of the catalytic converter, depending on the load region determined by the load region-determining means.

Further preferably, the catalyst bed temperature-estimating means accumulates a value dependent on the load region determined by the load region-determining means, and estimates the catalyst bed temperature of the catalytic converter, based on the accumulated value.

In another preferred embodiment, the abnormality-detecting device includes operating condition-determining means for determining whether the engine has reached the predetermined operating condition, based on an exhaust gas temperature of the engine.

Preferably, the predetermined operating condition of the engine is an operating condition in which the exhaust gas temperature is above a predetermined value.

More preferably, the abnormality-detecting device includes engine speed-detecting means for detecting rotational speed of the engine, load-detecting means for detecting load on the engine, load region-determining means for determining a load region in which the engine is operating, based on results of detection by the engine speed-detecting means and the load-detecting means, and exhaust gas temperature-estimating means for estimating the exhaust gas temperature, depending on the load region determined by the load region-determining means.

Further preferably, the exhaust gas temperature-estimating means accumulates a value dependent on the load region determined by the load region-determining means, and estimates the exhaust gas temperature, based on the accumulated value.

In another preferred embodiment, the abnormality-detecting device includes coolant temperature-detecting means for detecting a coolant temperature of the engine, and operating condition-determining means for determining whether the engine has reached the predetermined operating condition, based on the coolant temperature of the engine detected by the coolant temperature-detecting means.

Preferably, the predetermined operating condition is an operating condition in which the coolant temperature is above a predetermined value.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
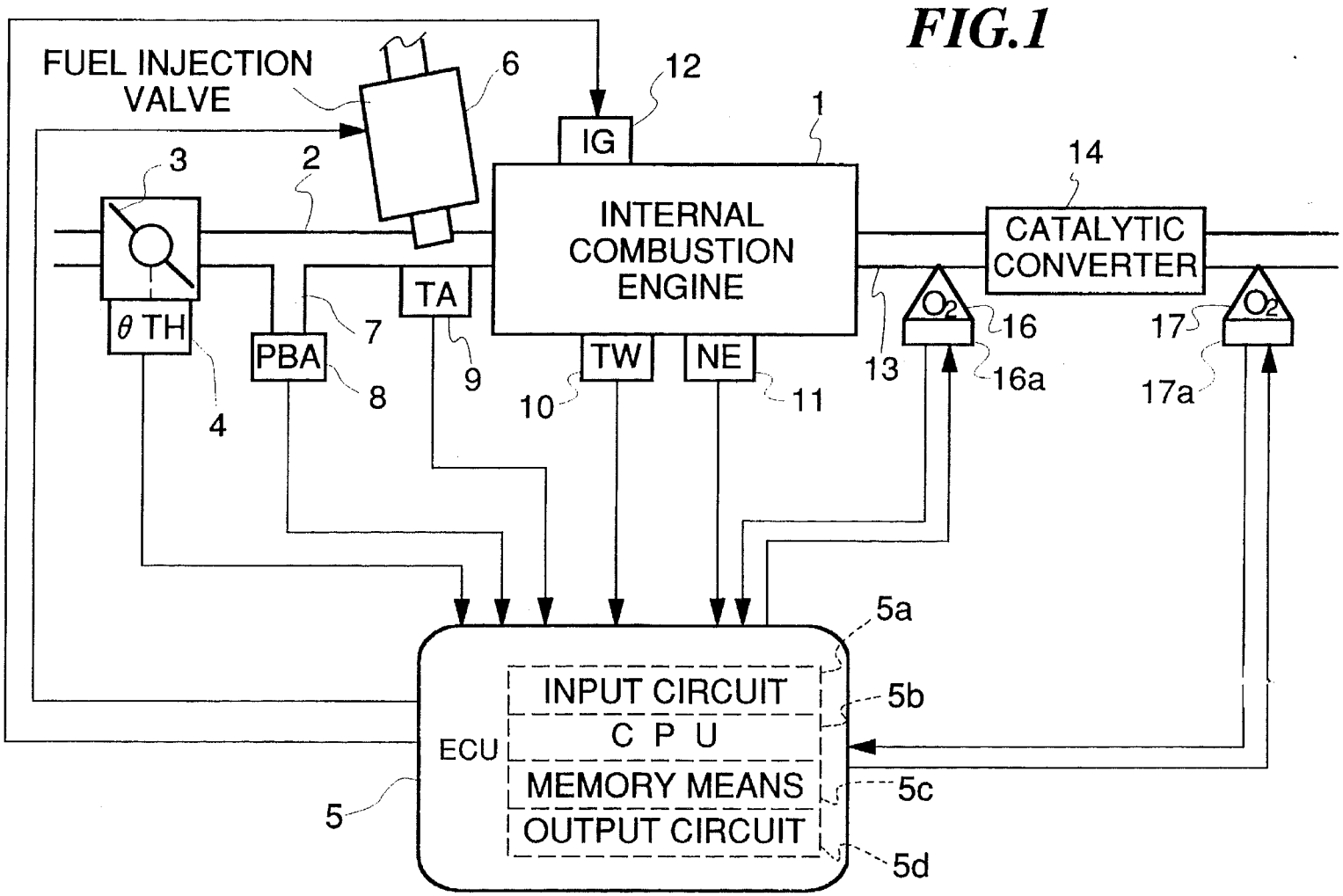
FIG. 1 is a block diagram showing the whole arrangement of an abnormality-detecting device for detecting abnormality of an exhaust gas component concentration sensor of an internal combustion engine, according to a first embodiment of the invention.

Referring first to FIG. 1, there is shown the whole arrangement of an abnormality-detecting device for detecting abnormality of an exhaust gas component concentration sensor of an internal combustion engine, according to a first embodiment of the invention.

In the figure, reference numeral 1 designates an internal combustion engine having four cylinders (hereinafter simply referred to as "the engine"). In an intake pipe 2 of the engine, there is arranged a throttle body 3 accommodating a throttle valve 3' therein. A throttle valve opening ($\Delta$TH) sensor 4 is connected to the throttle valve 3' for generating an electric signal indicative of the sensed throttle valve opening and supplying the same to an electronic control unit (hereinafter referred to as the ECU") 5.

Fuel injection valves 6 are each provided for each cylinder and arranged in the intake pipe 2 between the engine 1 and the throttle valve 3', and at a location slightly upstream of intake valves, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is mounted at an end of a branch conduit 7 branching off from the intake pipe 2 at a location immediately downstream of the throttle valve 3', for sensing absolute pressure (PBA) within the intake pipe 2, and is electrically connected to the ECU 5 for supplying an electric signal indicative of the sensed absolute pressure PBA to the ECU 5.

An intake air temperature (TA) sensor 9 is inserted into the intake pipe 2 at a location downstream of the intake pipe absolute pressure sensor 8 for supplying an electric signal indicative of the sensed intake air temperature TA to the ECU 5.

An engine coolant temperature sensor (TW) sensor 10, which may be formed of a thermistor or the like, is mounted in the coolant-filled cylinder block of the engine for supplying an electric signal indicative of the sensed engine coolant temperature TW to the ECU 5.

An engine rotational speed (NE) sensor 11 is arranged in facing relation to a camshaft or a crankshaft of the engine 1, neither of which is shown. The NE sensor 11 generates a pulse as a TDC signal pulse at each of predetermined crank angles whenever the crankshaft rotates through 180 degrees, the pulse being supplied to the ECU 5.

A spark plug 12 for each cylinder of the engine 1 is electrically connected to the ECU 5 to have ignition timing thereof controlled by a signal supplied therefrom.

A catalytic converter (three-way catalyst) 14 is arranged in an exhaust pipe 13, for purifying noxious components, such as HC, CO, and NOx, contained in the exhaust gases.

Further, oxygen concentration sensors 16, 17 as exhaust gas component concentration sensors (hereinafter referred to as "the upstream 02 sensor 16" and "the downstream 02 sensor 17", respectively) are arranged in the exhaust pipe 13 at respective locations upstream and downstream of the catalytic converter 14. These O2 sensors 16, 17 each have a sensor element thereof formed of a solid electrolyte of zirconia ($ZrO_2$). The sensors each have a characteristic that an electromotive force thereof drastically changes as the air-fuel ratio of the exhaust gases changes across a stoichiometric air-fuel ratio, so that an output signal thereof is inverted from a leaner side to a richer side with respect to the stoichiometric air-fuel ratio and vice versa. More specifically, the O2 sensors 16, 17 each deliver a high-level output signal (rich signal) when the air-fuel mixture is rich, and on the other hand a low-level output signal (lean signal) when the same is lean, in response to the concentration of oxygen in the exhaust gases at the respective locations in the exhaust pipe. The 02 sensor 16, 17 are electrically connected to the ECU 5 to deliver the output signals to the ECU 5. Further, the O2 sensors 16, 17 have heaters 16*a*, 17*a* incorporated therein for accelerating the activation of the sensors. The 02 sensors 16, 17 have their ON/OFF operations controlled by signals supplied from the ECU 5.

The ECU 5 is comprised of an input circuit 5*a* having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as the "CPU") 5*b*, memory means 5*c* storing various operational programs which are executed by the CPU 5*b*, and various maps, referred to hereinafter, and for storing results of calculations therefrom, etc., an output circuit 5*d* which outputs driving signals to the fuel injection valves 6, the spark plugs 12, and the heaters 16*a*, 17*a* of the O2 sensors 16, 17.

Based on signals indicative of operating conditions of the engine from various sensors including the sensors mentioned above, the CPU 5*b* determines operating conditions of the engine including an air-fuel ratio feedback control region in which the air-fuel ratio should be controlled in response to the signals from the O2 sensors 16, 17 indicative of the concentration of oxygen contained in the exhaust gases, and air-fuel ratio open-loop control regions outside the feedback control region, and calculates a fuel injection period TOUT over which each of the fuel injection valves 6 is to be opened, depending on the determined operating conditions of the engine, by the use of the following equation:

$$Tout = Ti \times KO2 \times KLS \times K1 \times K2 \quad (1)$$

wherein Ti represents a basic fuel injection period, which is determined based on the engine rotational speed NE and the intake pipe absolute pressure PBA by the use of a Ti map stored in the memory means 5*c*.

KO2 represents an air-fuel ratio correction coefficient determined based on the signals from the 02 sensors 16, 17, which is set during the air-fuel ratio feedback control such that the air-fuel ratio (the concentration of oxygen in exhaust gases) detected by the upstream O2 sensor 16 becomes equal to a desired air-fuel ratio (oxygen concentration), and during the open-loop control to predetermined values dependent on operating conditions of the engine.

KLS represents a leaning correction coefficient which is set to a predetermined value (<1) when the engine is in a predetermined air-fuel ratio-leaning condition or in a fuel-cut state during deceleration, and otherwise set to "1.0".

K1 and K2 represent other correction coefficients and correction variables which are set depending on operating conditions of the engine to such values as optimize operating characteristics of the engine, such as fuel consumption and accelerability.

Figure 2:
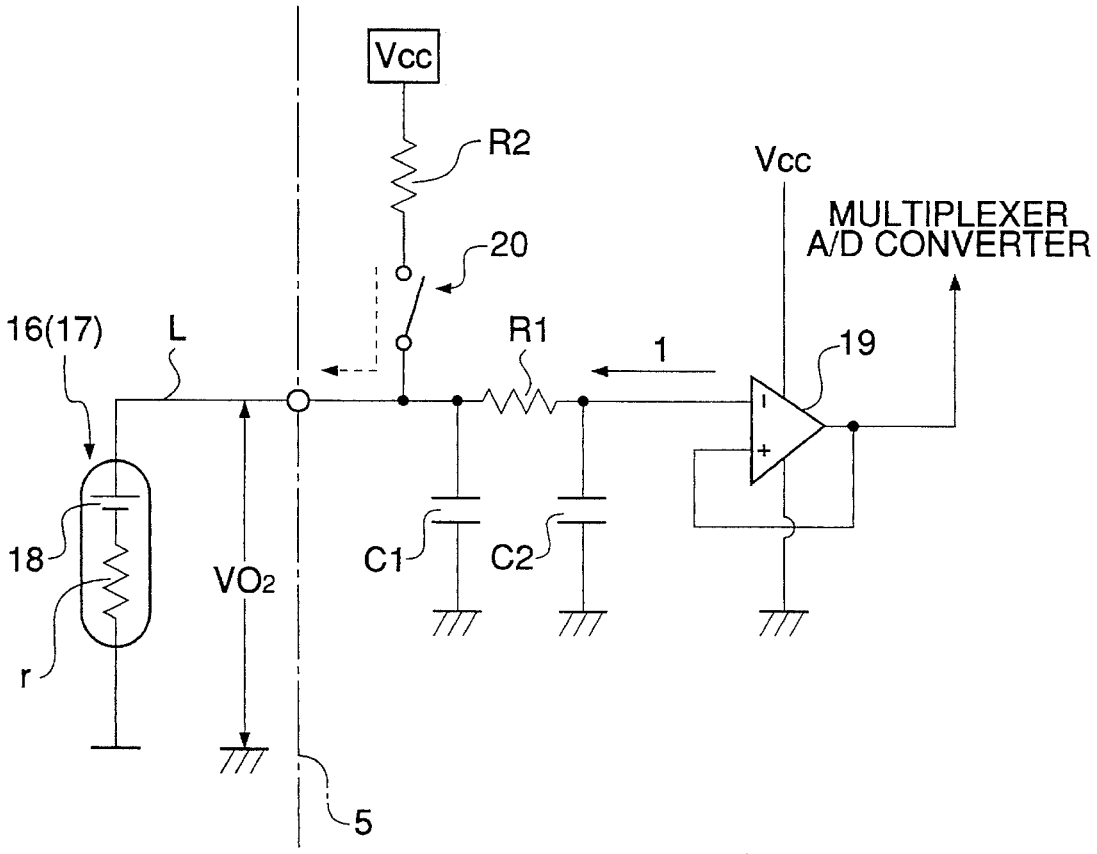
FIG. 2 is a circuit diagram showing the circuit configuration of an 02 sensor and an input circuit therefor within an ECU, including a checker circuit.

FIG. 2 shows the circuit configuration of the O2 sensor 16 (17) and an input circuit therefor provided within the ECU 5, which is connected to each O2 sensor 16(or 17), including a checker circuit for detecting abnormality of the O2 sensor.

The abnormality-detecting processing of the downstream O2 sensor 17 will be described in detail hereinbelow, and a similar abnormality-detecting processing can be also applied to the upstream O2 sensor 16.

As shown in the figure, the downstream O2 sensor 17 (or 16) is simplify represented by the internal impedance r of the sensor element and a cell 18. The O2 sensor 17 (or 16) has one end thereof grounded to the wall of the exhaust pipe 13, and the other end connected to the ECU 5 via a signal line L. The input circuit 5*a* of the ECU 5, which is connected to the O2 sensor 17 (or 16), includes a low-pass filter formed of two capacitors C1 and C2 and a resistance R1, and an operational amplifier 19. The output signal (output voltage) SVO2 from the downstream O2 sensor 17 (PVO2 in the case of the upstream O2 sensor 16) is applied via the low-pass filter to a non-inverting input terminal of the operational amplifier 19, where the output signal is amplified and then supplied to a multiplexer, and an analog-to-digital converter, neither of which is shown, within the ECU 5.

A series circuit formed of a switch 20 and a resistance R2, which serves as the checker circuit, is interposed between a junction of the capacitor C1 and the resistance R1, and a terminal through which is supplied a predetermined power supply Vcc. The switch 20 has its ON/OFF operation controlled by a control signal from the output circuit 5*d*. Alternatively, the switch 20 may be implemented by any suitable switching element.

The switch 20 of the checker circuit is turned on when the output voltage SVO2 from the downstream O2 sensor 17 has been stable without any significant change over a predetermined time period, e.g. when the supply of fuel is cut off or when the throttle valve 13' is fully opened, whereby an increased amount of current flows into the downstream O2 sensor 17. Then, the output voltage SVO2 is checked to detect abnormality of the downstream O2 sensor 17.

According to the abnormality-detecting device of the present invention, the O2 sensors 17 (16) is determined to be normally functioning when the amount of a change in the output voltage from the sensor is above a predetermined value, and determination as to abnormality of the O2 sensors 17 (16) is deferred before the engine reaches a predetermined operating condition after the start of the engine 1 when the change amount in the output voltage is below the predetermined value.

Figure 3:
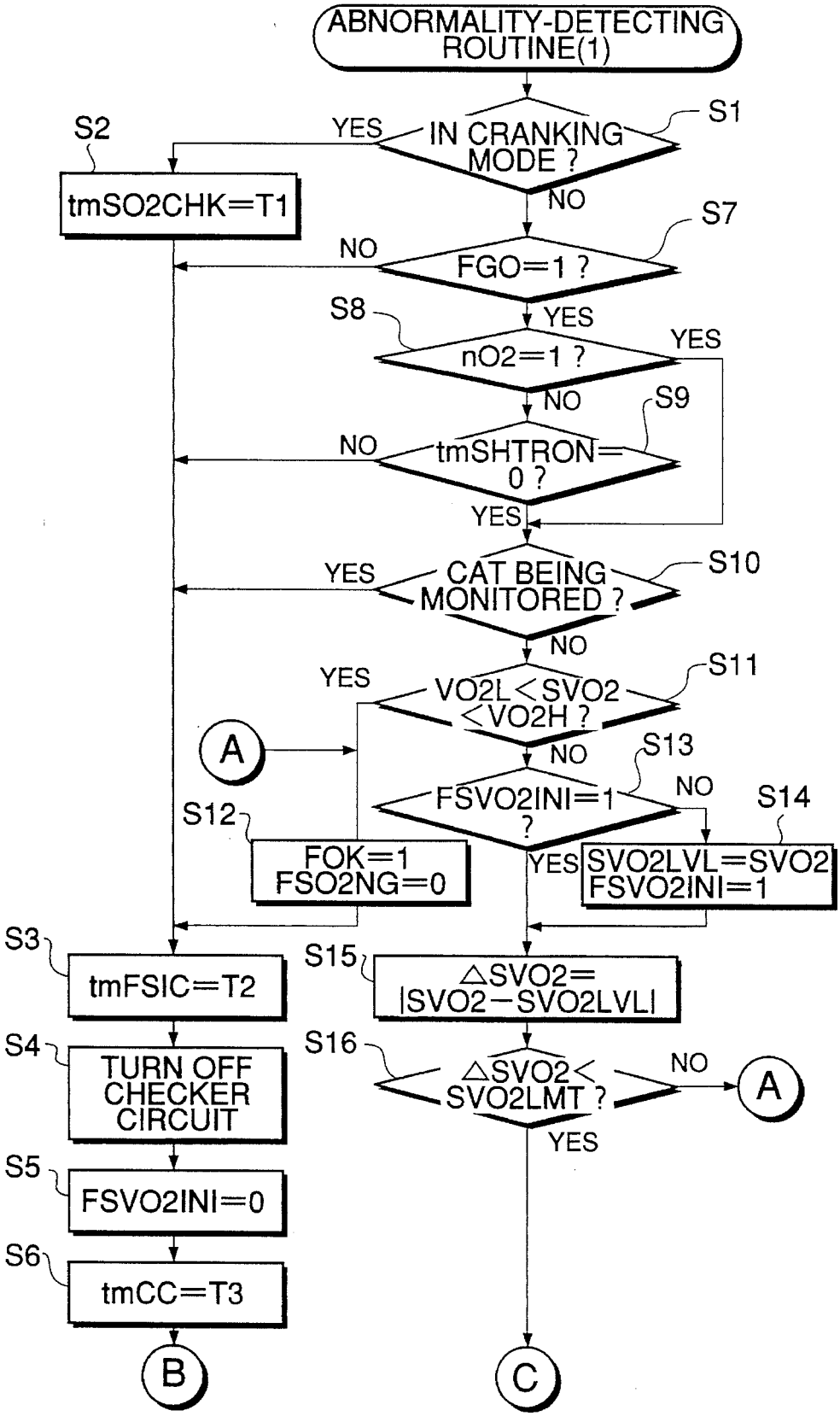
FIG. 3 is a flowchart showing an abnormality-detecting routine for detecting abnormality of the exhaust gas component concentration sensor appearing in FIG. 1, according to the first embodiment.
Figure 4:
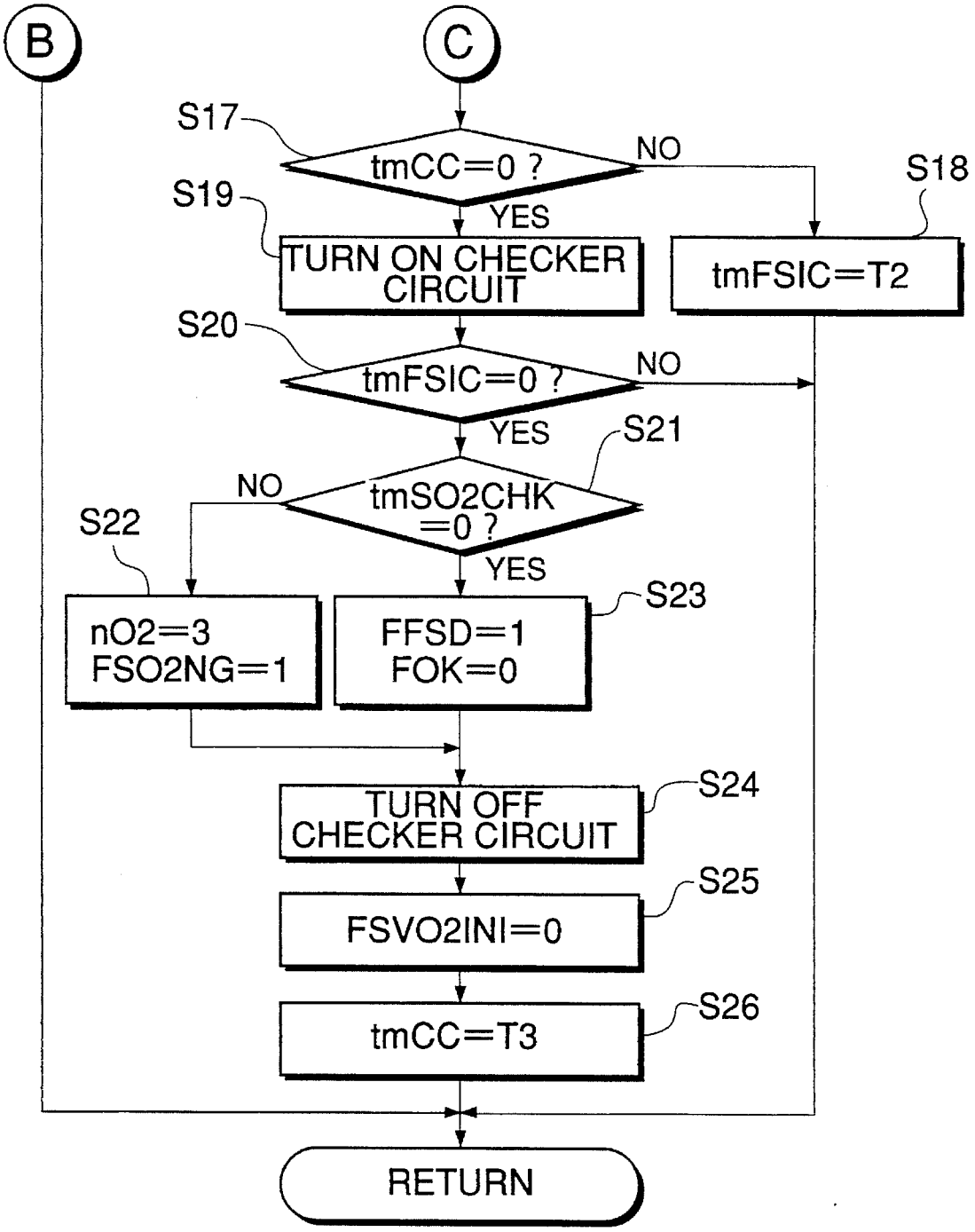
FIG. 4 is a continued part of the FIG. 3 flowchart.

FIG. 3 and FIG. 4 show an abnormality-detecting routine according to a first embodiment of the invention, which is executed by the CPU 5*b* as background processing immediately after the start of the engine.

Referring first to FIG. 3, it is determined at a step S1 whether or not the engine is in a cranking mode. This determination is made by determining whether or not a starter switch, not shown, of the engine is ON and at the same time the engine rotational speed is below a predetermined cranking speed. If the answer to this question is affirmative (YES), i.e. if the engine 1 is in the cranking mode, a tmSO2CHK timer for measuring a time period elapsed after the start of the engine is set to a predetermined time period T1 at a step S2, and then a tmFSIC timer for use in detecting abnormality is set to a predetermined time period T2 at a step S3. The predetermined time period T1 set to the tmSO2CHK timer is equal to 15 minutes, for example, which is long enough for the inside of the downstream O2 sensor 17 to become dry through evaporation of water condensed therein e.g. at the start of the engine in a cold condition, by heat generated by operation of the engine. The predetermined time period T2 set to the tmFSIC timer is equal to 2.5 seconds, for example, which is long enough for detecting abnormality of the O2 sensor after the switch 20 of the checker circuit is turned on.

Then, the program proceeds to a step S4, where the switch 20 of the checker circuit is turned off, and a flag FVOZINI is set to "0" at a step S5 to indicate a non-initialized state of a change reference value, referred to hereinafter. Further, a tmCC timer for measuring a time period for controlling monitoring intervals, referred to hereinafter, is set to a predetermined time period T3 (e.g. 2.5 seconds) at a step S6, followed by terminating the program.

On the other hand, if the answer to the question of the step S1 is negative (NO), i.e. if the engine is operating in a basic mode, the program proceeds to a step S7, where it is determined whether or not a flag FGO is equal to "1". The flag FGO is set to "1" when the monitoring of the downstream O2 sensor 17 is permitted, and hence when the answer to the question of the step S7 is negative (NO), the steps S3 to S6 are executed, followed by terminating the program. On the other hand, if the answer to the question of the step S7 is affirmative (YES), the program proceeds to a step S8, where it is determined whether or not a flag nO2 is equal to 1. The flag nO2 is set to "0" when the downstream O2 sensor 17 is inactive, and set to "1" when it is activated. Further, the flag nO2 is set to "2" when the O2 sensor 7 ceases to be active after it has been activated, and it is set to "3" when the O2 sensor is inactive within a predetermined time period after the start of the engine.

If the answer to the question of the step S8 is affirmative (YES), i.e. if the downstream O2 sensor 17 is active, the program proceeds to a step S10, whereas if the answer is negative (NO), the program proceeds to a step S9, where it is determined whether or not a tmSHTRON timer has run out, which operates to measure a time period during which the heater 17*a* of the O2 timer 17 is energized. The tmSHTRON timer is formed by a downcounter and set to a predetermined time period (e.g. 60 seconds) simultaneously with the start of energization of the heater 17*a* of the downstream 02 sensor 17. Thus, at the step S9, it is determined whether or not the predetermined time period set to the tmSHTRON timer has been counted down to 0. If the answer to the question of the step S9 is negative (NO), i.e. if the tmSHTRON timer has not run out yet, the steps S3 to S6 are executed, followed by terminating the program.

On the other hand, if the answer to the question of the step S9 is affirmative (YES), the program proceeds to a step S10, where it is determined whether or not the catalytic converter 14 is being monitored for abnormality. If the answer to this determination is affirmative (YES), i.e. if the catalytic converter 14 is being monitored for abnormality, the steps S3 to S6 are executed, followed by terminating the program without carrying out abnormality detection of the downstream O2 sensor 17.

If the answer to the question of the step S10 is negative (NO), the program proceeds to a step S11, where it is determined whether or not the output voltage from the downstream O2 sensor 17 falls between a predetermined lower limit value VO2L (e.g. 0.08 V) and a predetermined upper limit value VO2H (e.g. 1 V). If the answer to this question is affirmative (YES), it is determined that the output voltage SV02 from the downstream O2 sensor 17 is normal, whereby a flag FOK is set to "1", and at the same time a flag FSO2NG to "0" to thereby indicate that no abnormality of the downstream O2 sensor 17 has been detected within the predetermined time period after the start of the engine, at a step S12. That is, the flag FOK is set to "1" when the O2 sensor is not in an abnormal condition caused by aging, etc. while the affirmative answer to the question of the step S11 means that the output voltage SV02 from the downstream O2 sensor 17 is within a predetermined normal range of VO2L <SVO2 <VO2H, and hence the flag FOK is set to "1" at the step S12. The flag FSO2NG is set to "1" when abnormality of the downstream O2 sensor 17 is detected within the predetermined time period after the start of the engine, and it is set to "0" since no abnormality of the same is detected in the present case. After the setting of theses flags at the step S12, the steps S3 to S6 are executed, followed by terminating the program.

If the answer to the question of the step S11 is negative (NO), i.e. if the output voltage from the downstream O2 sensor 17 falls outside the predetermined normal range, steps S13 et seq. are executed to carry out determination as to abnormality of the downstream O2 sensor 17.

At the step S13, it is determined whether or not the flag FSVO2INI is equal to "1". The flag FSVO2INI is set to "1" when the change reference value SVOLVL to be compared with the output voltage SV02 from the downstream O2 sensor 17 has been initialized. In the first loop of execution of the step S13, this flag is equal to "0", so that the answer to the step S13 is negative (NO), and then the program proceeds to a step S14, where the output voltage SVO2 from the downstream 02 sensor 17 detected in the present loop is set to the change reference value SVO2LVL, thereby effecting initialization of the change reference value SVO2LVL, and the flag FSVO2INI is set to "1" to indicate that the change reference value SVO2LVL has been initialized, followed by the program proceeding to a step S15. When the step S13 is executed in subsequent loops, the answer of the question thereof becomes affirmative (YES), so that the program jumps over to the step S15.

At the step S15, an amount of variation in the output voltage VO2 from the downstream O2 sensor 17, i.e. the absolute value ΔSVO2 of the difference between the output voltage SVO2 and the change reference value SVO2LVL is calculated, and then at the following step S16, it is determined whether or not the absolute value ΔSVO2 of the difference is smaller than a variation limit SVO2LMt (e.g. 0.04 V). If the answer to this question is negative (NO), i.e. if the absolute value ΔSVO2 of the difference is equal to or larger than the variation limit SVO2LMt, it is determined that the downstream O2 sensor 17 is normally functioning, and after execution of the step S12, the steps S3 to S6 are executed, followed by terminating the program.

On the other hand, if the answer to the question of the step S16 is affirmative (YES), it means that the absolute value ΔSVO2 of the difference is abnormally small. Therefore, there is a probability that the downstream O2 sensor 17 is abnormal, and then the program proceeds to a step S17 shown in FIG. 14.

Figure 14:
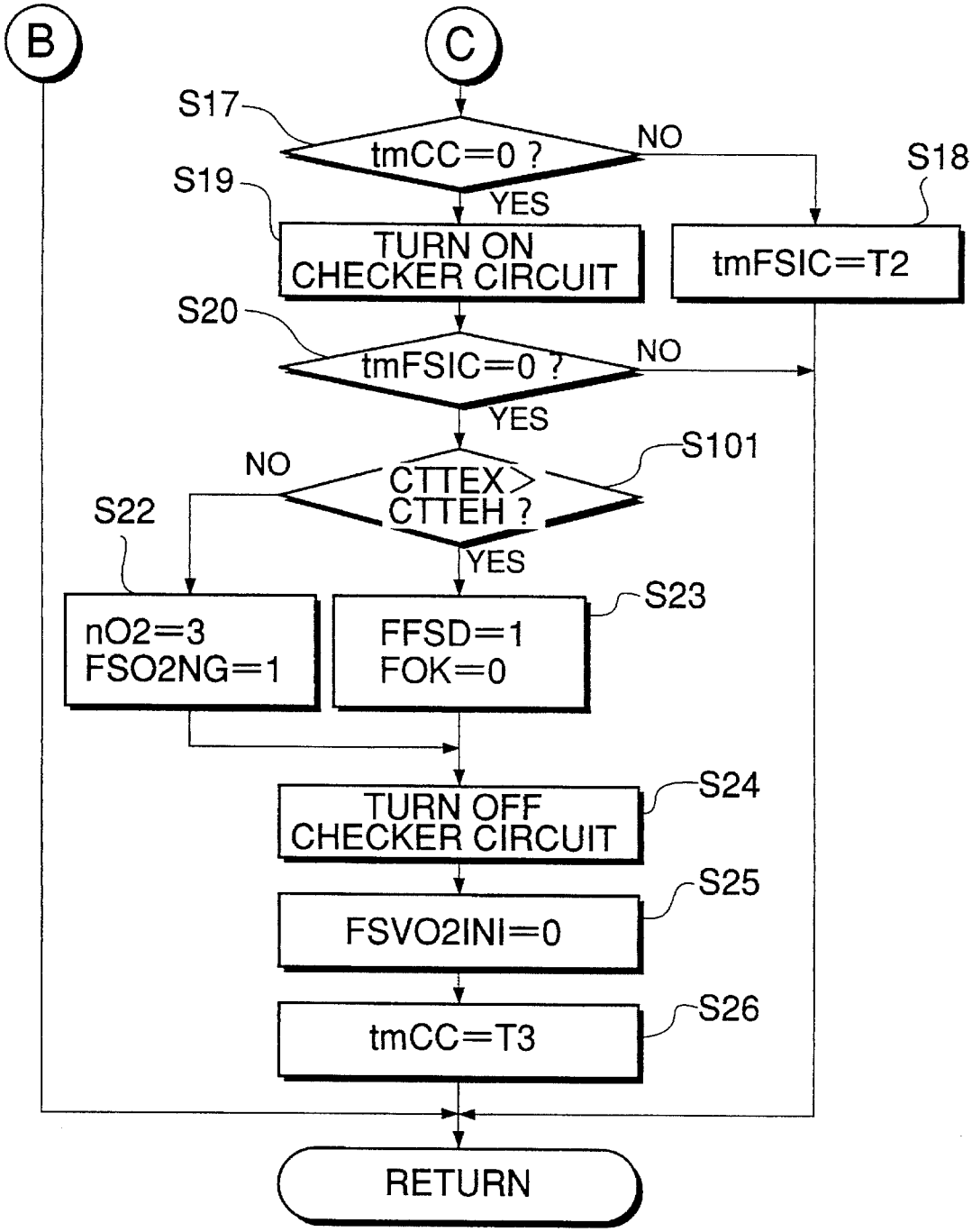
FIG. 14 is a flowchart showing an essential part of an abnormality-detecting routine for detecting abnormality of the exhaust gas component concentration sensor, according to a third embodiment of the invention.

At the step S17 in FIG. 14, it is determined whether or not the tmCC timer for measuring the time period for controlling the monitoring intervals has run out. If the tmCC timer has not run out, the program proceeds to a step S18, where the tmFSIC timer for use in detecting abnormality is set to the predetermined time period T2 (e.g. 2.5 seconds), followed by terminating the program. On the other hand, if the answer to the question of the step S17 is affirmative (YES), i.e. if the predetermined time period T3 has elapsed, the switch 20 of the checker circuit is turned on at a step S19, and then it is determined at a step S20 whether or not the tmFSIC timer has run out. If the answer to this question is negative (NO), the program is immediately terminated. If the answer to this question is affirmative (YES), it is determined at a step S21 whether or not the tmSO2CHK timer set at the step S2 in FIG. 3 has run out. If the answer is negative (NO), the flag nO2 is set to "3", and at the same time the flag FSO2NG is set to "1" at a step S22, followed by the program proceeding to a step S24. That is, in this case, before the predetermined time period T1 set to the tmSO2CHK timer elapses after the start of the engine, the downstream O2 sensor 17 is regarded as inactive, and the abnormality determination of the downstream O2 sensor 17 is deferred.

On the other hand, if the answer to the question of the step S21 is affirmative (YES), a flag FFSD is set to "1", and the flag FOK is set to "0" at a step S23, followed by the program proceeding to the step S24. The flag FFSD is set to "1" when the downstream O2 sensor 17 has been detected to be abnormal, while the affirmative answer to the question of the step S21 means that there is an abnormality in the downstream O2 sensor 17 even after the predetermined time period T1 has elapsed after the start of the engine. Therefore, the flag FFSD is set to "1", and at the same time the flag FOK is set to "0", whereby it is indicated that the downstream O2 sensor 17 is determined to be abnormal.

Then, the switch 20 of the checker circuit is turned off at the step S24, and at a step S25, the flag FSVO2INI is set to "0", to thereby permit initialization of the change reference value SVO2LVL. Then, at a step S26, the tmCC timer is set to the predetermined time period T3 again, followed by terminating the program.

In the above described manner, even when the amount of change in the output from the downstream 02 sensor 17 is abnormally small, and hence there is a probability that the downstream O2 sensor 17 is abnormal, the determination as to abnormality of the downstream O2 sensor 17 is deferred until the predetermined time period elapses after the start of the engine. This makes it possible to defer the abnormality determination until after the water condensed within the O2 sensor evaporates, for example, thereby preventing erroneous determination as to abnormality of the downstream O2 sensor 17. Further, while the abnormality determination is deferred, the abnormality diagnosis is continued, thereby making it possible to greatly improve the accuracy of abnormality determination. Further, while the abnormality determination of the downstream O2 sensor 17 is deferred, the downstream O2 sensor 17 is regarded as inactive, whereby it is possible to inhibit the air-fuel ratio control and/or other abnormality diagnoses utilizing the output from the downstream O2 sensor 17, thereby preventing degradation of the drivability and erroneous determinations in the abnormality diagnoses.

Figure 5:
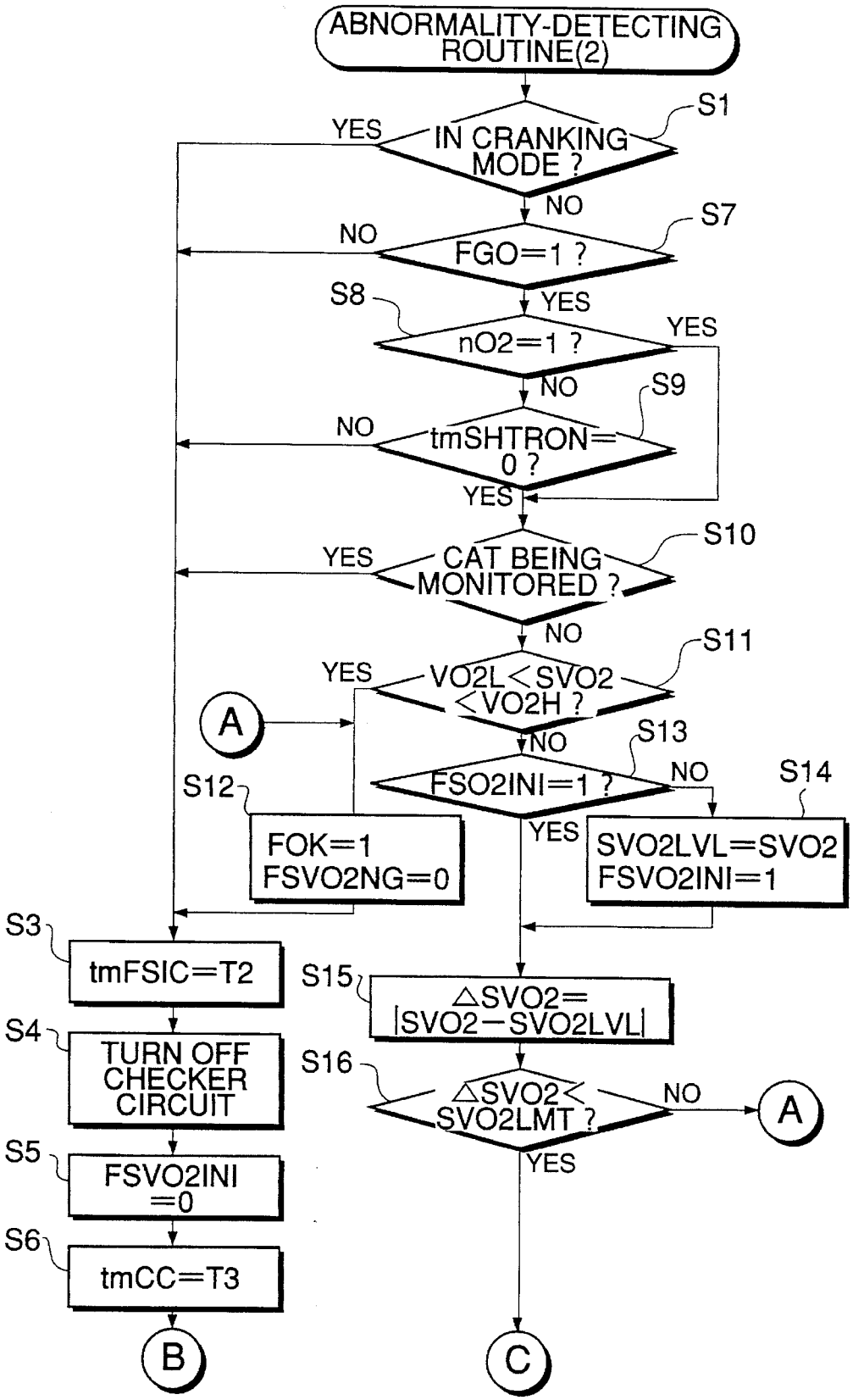
FIG. 5 is a flowchart showing an abnormality-detecting routine for detecting abnormality of the exhaust gas component concentration sensor, according to a second embodiment.
Figure 6:
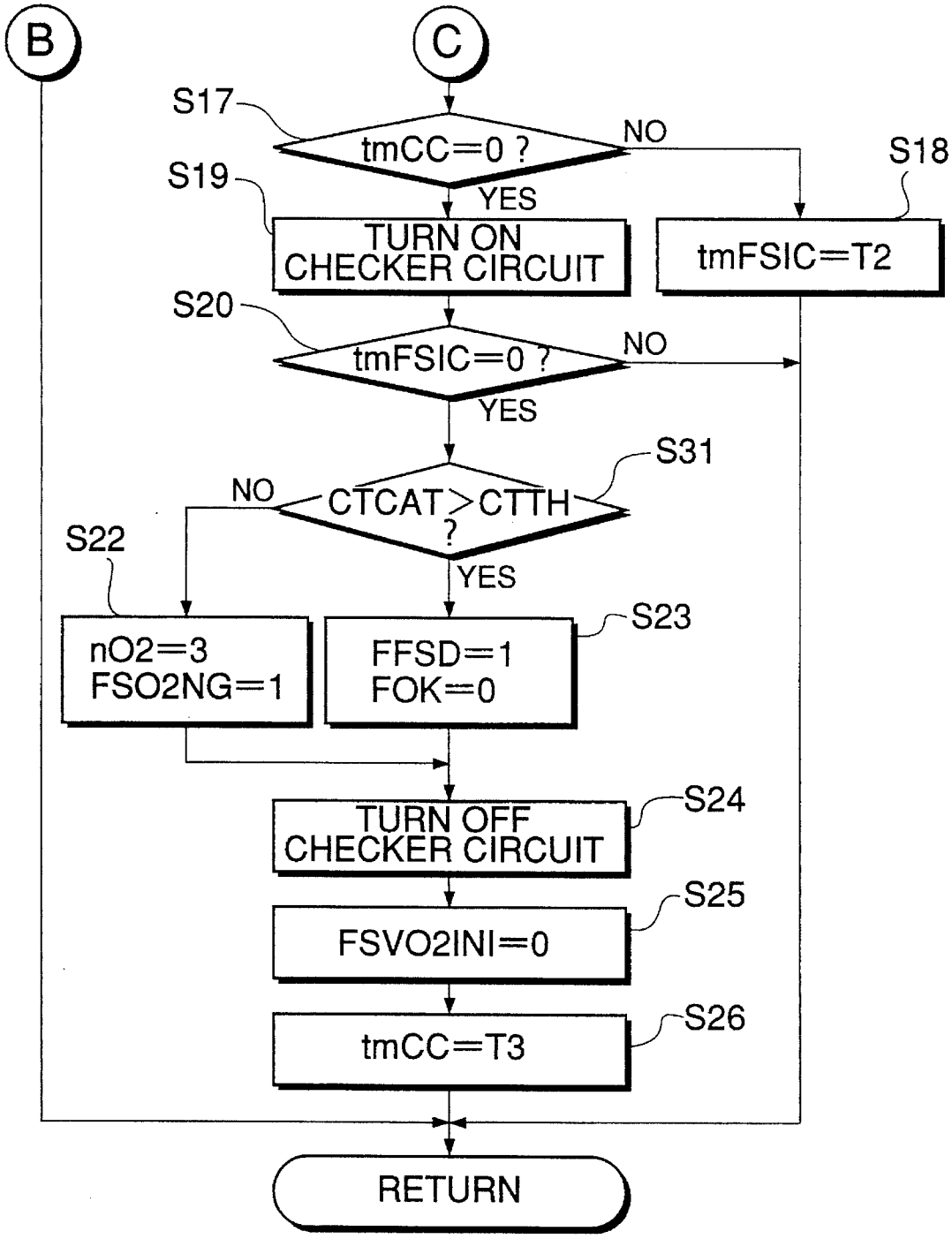
FIG. 6 is a continued part of the FIG. 5 flowchart.

FIG. 5 and FIG. 6 show an abnormality-detecting routine according to a second embodiment of the invention. This embodiment is distinguished from the first embodiment described above in that the tmSO2CHK timer for setting the period during which the abnormality determination should be deferred is replaced by a catalyst temperature-estimating counter for estimating the catalyst bed temperature TCAT of the catalytic converter 14 based on engine operating parameters. In this embodiment, the time period during which the abnormality determination should be deferred is determined based on the count CTCAT of the catalyst temperature-estimating counter.

More specifically, FIG. 5 is distinguished from FIG. 3 only in that the step S2 for setting the tmSO2CHK timer is omitted, and FIG. 6 is distinguished from FIG. 4 only in that the step S21 for determining whether the tmSO2CHK timer has run out is replaced by a step S31 where it is determined whether or not the count CTCAT of the catalyst temperature-estimating counter exceeds a predetermined value CTTH. If the answer to the question of the step S31 is negative (NO), similarly to the first embodiment, the abnormality determination is deferred at the step S22, and when the count CTCAT of the counter increases above the predetermined value CTTH thereafter, the abnormality determination is carried out on the downstream O2 sensor 17. Therefore, description of the other steps in FIGS. 5 and 6, which are identical with the corresponding steps in FIGS. 3 and 4, is omitted.

Next, the manner of estimating the catalyst bed temperature TCAT by the use of the catalyst temperature-estimating counter will be described in detail.

Figure 7:
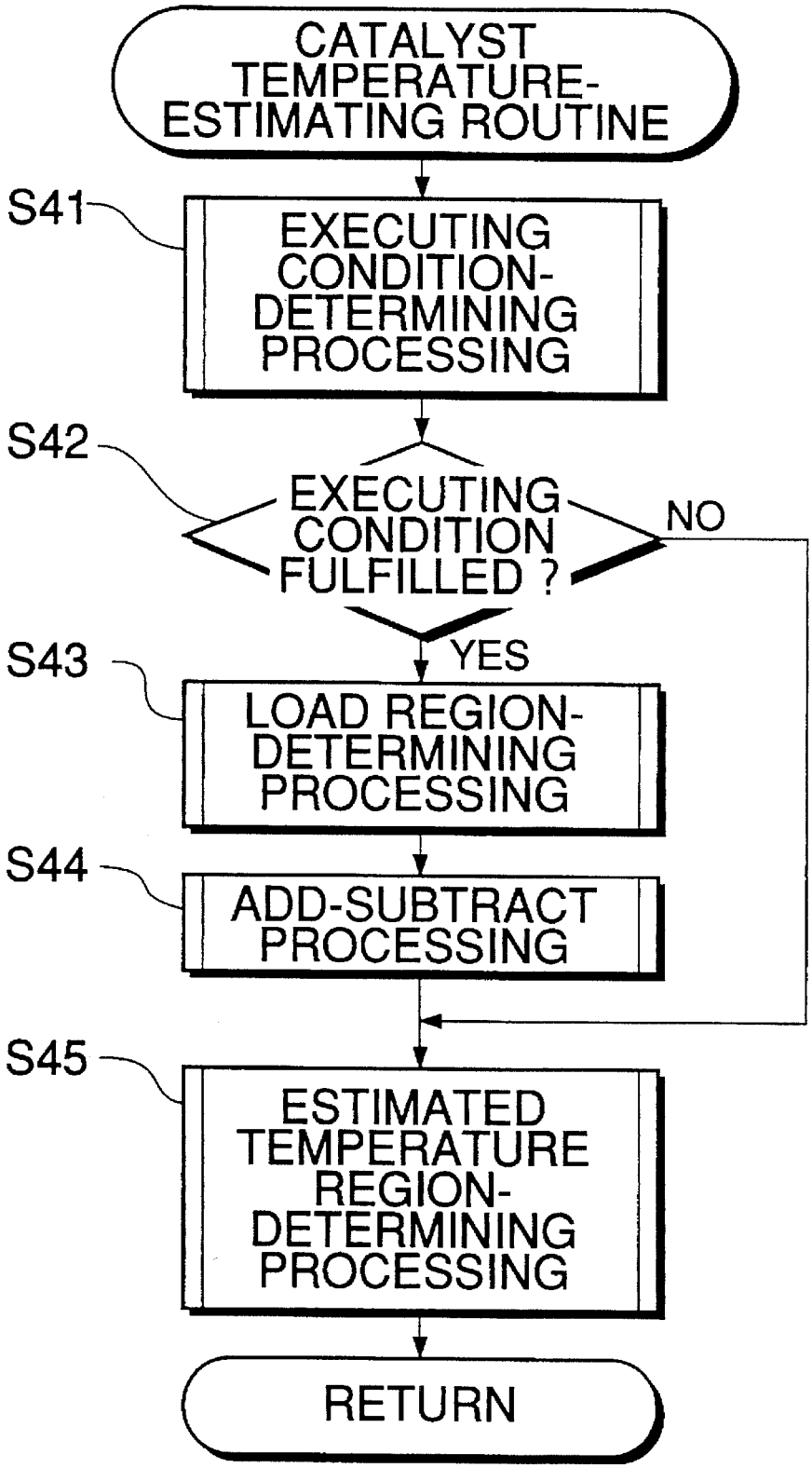
FIG. 7 is a flowchart showing a catalyst temperature-estimating routine.

FIG. 7 shows a catalyst temperature-estimating routine, which is executed by the CPU **5*b* in synchronism with generation of each false signal pulse e.g. at intervals of 100 msec. by the use of a timer incorporated in the ECU 5** immediately after the start of the engine.

First, at a step S41, an executing condition-determining routine is carried out to determine whether the estimation of the catalyst bed temperature should be carried out. Then, at a step S42, it is determined whether or not the executing condition for executing the estimation of the catalyst bed temperature is fulfilled. If the answer to this question is negative (NO), the program proceeds to a step S45, whereas if the answer is affirmative (YES), a load region-determining routine is carried out to determine a region of load on the engine based on operating parameters of the engine. Then, at a step S44, an add-subtract processing routine is carried out to perform the add-subtract processing on the count CTCAT of the catalyst temperature-estimating counter, followed by the program proceeding to the step S45. At the step S45, an estimated temperature region-determining routine is carried out to determine an estimated temperature region of the catalyst bed temperature 14 based on the count CTCAT of the catalyst temperature-estimating counter.

Figure 8:
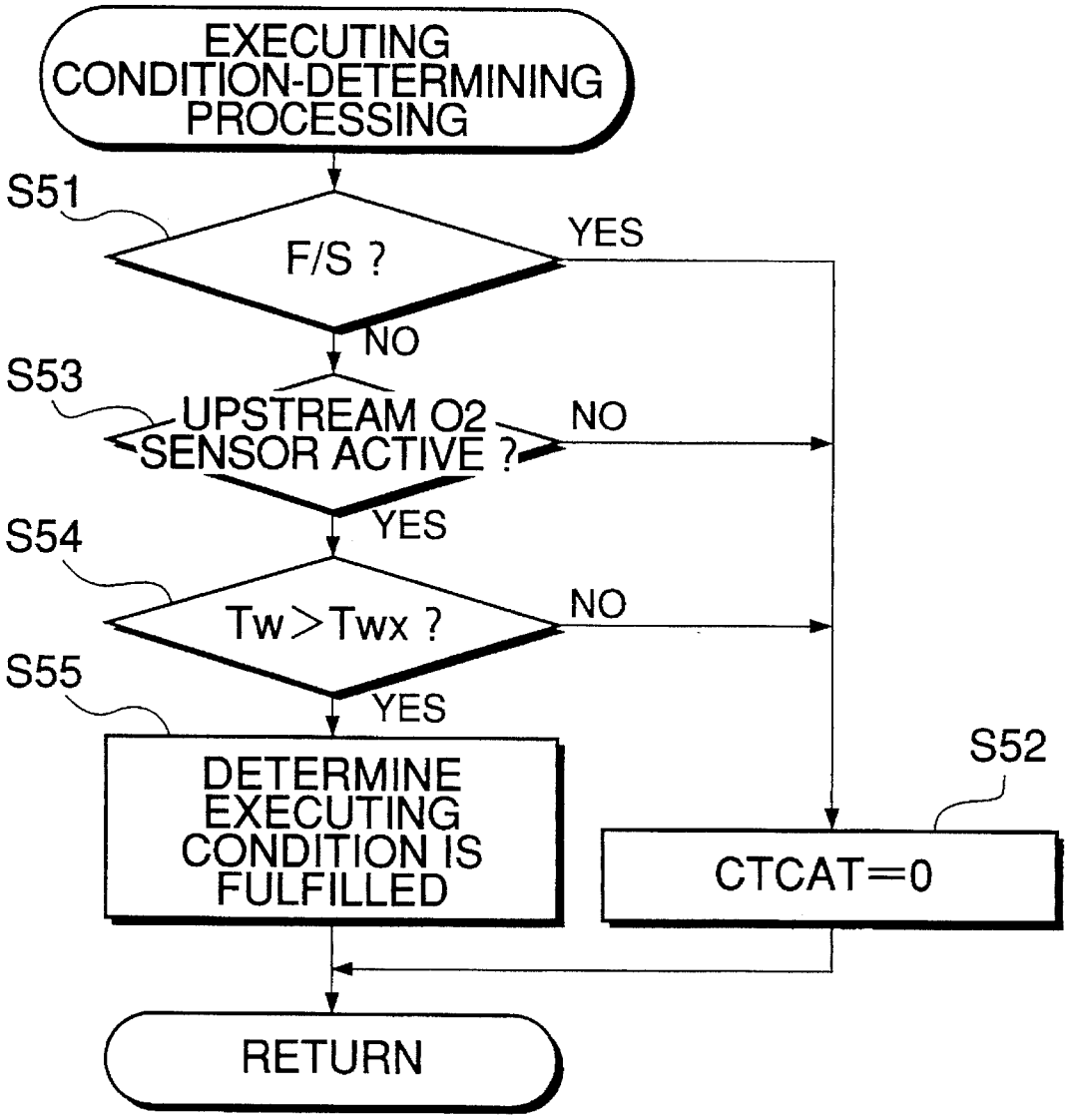
FIG. 8 is a flowchart showing a subroutine for an executing condition-determining processing forming part of the FIG. 7 routine.

FIG. 8 shows details of the executing condition-determining routine executed at the step S41 in FIG. 7.

At a step S51, it is determined whether or not any predetermined fail-safe action for the engine operation is being carried out. If the answer to this question is affirmative (YES), the count CTCAT of the catalyst temperature-estimating counter is reset to "0" at a step S52, followed by the program returning to the FIG. 7 routine, whereas if the answer is negative (NO), the program proceeds to a step S53, where it is determined whether or not the upstream O2 sensor 16 has been activated. If the answer to this question is affirmative (YES), it is determined at a step S54 whether or not the engine coolant temperature TW is higher than a predetermined value TWX, e.g. 30° C. If the answer to this question is affirmative (YES), it is determined at a step S55 that the executing condition for executing the estimation of the catalyst temperature is fulfilled, followed by the program returning to the step S55 in FIG. 7. On the other hand, if any of the answers to the questions of the steps S53 and S54 is negative (NO), the count CTCAT of the counter is set to "0" at a step S52, followed by the program returning to the FIG. 7 program.

Figure 9:
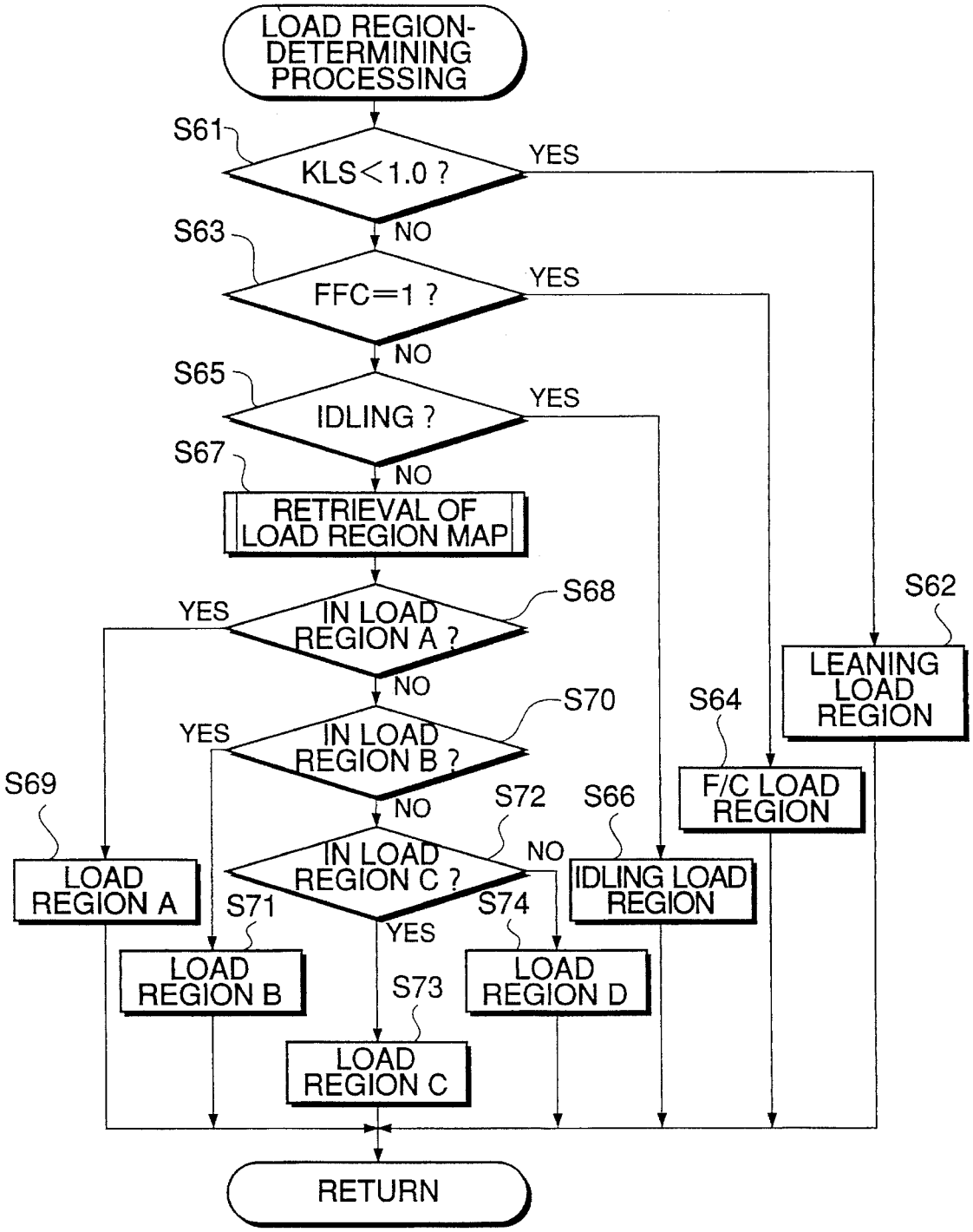
FIG. 9 is a flowchart showing a subroutine for a load region-determining processing forming part of the FIG. 7 routine.

FIG. 9 shows details of the load region-determining routine executed at the step S43 of FIG. 7.

At a step S61, it is determined whether or not the leaning coefficient KLS is smaller than 1.0. If the answer to this question is affirmative (YES), the program proceeds to a step S62, where it is determined that the engine is in a leaning load region corresponding to the air-fuel ratio-leaning region of the engine, followed by the program returning to the FIG. 7.

Further, if the answer to the question of the step S61 is negative (NO), the program proceeds to a step S63, where it is determined whether or not fuel cut (interruption of fuel supply to the engine) is being carried out. The determination as to the fuel cut is carried out based on the engine rotational speed NE and the valve opening a TH of the throttle valve 3', more specifically by carrying out a fuel cut-determining routine, not shown. If the answer to the question of the step S63 is affirmative (YES), the program proceeds to a step S64, where it is determined that the engine is in a fuel-cut load region corresponding to the fuel-cut region of the engine, followed by the program returning to the FIG. 7 program.

If the answer to the question of the step S63 is negative (NO), the program proceeds to a step S65, where it is determined whether or not the engine is idling. The determination as to idling of the engine is carried out by determining whether the engine rotational speed NE is lower than a predetermined value (e.g. 900 rpm) and at the same time the throttle valve opening ΔTH of the throttle valve 3' is smaller than a predetermined value Δidl, or whether the engine rotational speed NE is lower than the predetermined value and at the same time the intake pipe absolute pressure PBA is on a lower engine load side than a predetermined value. Then, if the answer to the question of the step S65 is affirmative (YES), the program proceeds to a step S66, where it is determined that the engine is in an idling load region corresponding to the idling region of the engine, followed by the program returning to the FIG. 7 routine.

On the other hand, if the answer to the question 15 of the step S65 is negative (NO), the program proceeds to a step S67, where a load region map is retrieved to determine a load region according to operating conditions of the engine.

Figures 10, 12:
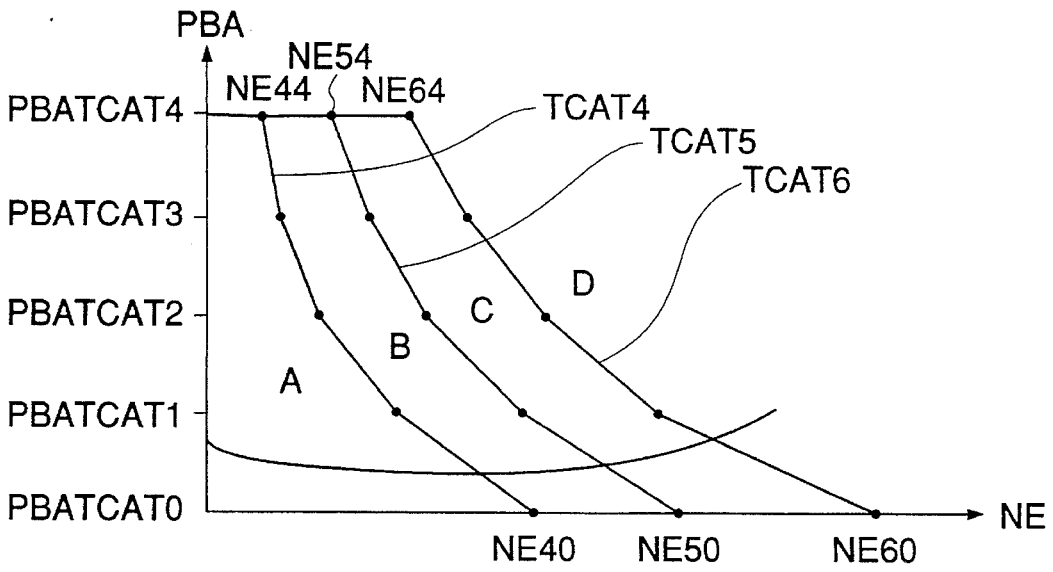
FIG. 10 shows a load region map set according to engine rotational speed, intake pipe absolute pressure, and estimated catalyst temperature.
FIG. 12 shows an incremental value/decremental value-selecting map set according to a present load region and an immediately preceding estimated temperature region.

The load region map is set, e.g. as shown in FIG. 10 such that load regions A to D are provided according to the engine rotational speed NE, the intake pipe absolute pressure PBA, and the catalyst temperature TCAT. More specifically, in FIG. 10, a TCAT4 characteristic curve (e.g. corresponding to 400° C. of the catalyst bed temperature TCAT) is provided correspondingly to engine rotational speed values of NE40 to NE44, and intake pipe absolute pressure values PBATCATO to PBATCAT4, a TCAT5 characteristic curve (e.g. corresponding to 500° C. of the catalyst bed temperature TCAT) is provided correspondingly to engine rotational speed values of NE50 to NE54, and intake pipe absolute pressure values PBATCAT0 to PBATCAT4, and a TCAT6 characteristic curve (e.g. corresponding to 600° C. of the catalyst bed temperature TCAT) is provided correspondingly to engine rotational speed values of NE60 to NE64, and intake pipe absolute pressure values PBATCATO to PBATCAT4. The load regions A to D are determined according to the engine rotational speed NE and the intake pipe absolute pressure PBA.

That is, after the load region map is retrieved at the step S67, it is determined according to the engine rotational speed NE and the intake pipe absolute pressure PBA at a step S68 whether or not the engine is in the load region A. If the answer to this question is affirmative (Yes), it is determined at a step S69 that the engine is in the load region A, followed by the program returning to the FIG. 7 program.

On the other hand, if the answer to the question of the step S68 is negative (NO), it is determined according to the engine rotational speed NE and the intake pipe absolute pressure at a step S70 whether or not the engine is in the load region B. If the answer to this question is affirmative (Yes), it is determined at a step S71 that the engine is in the load region B, followed by the program returning to the FIG. 7 program.

On the other hand, if the answer to the question of the step S70 is negative (NO), it is determined according to the engine rotational speed NE and the intake pipe absolute pressure at a step S72 whether or not the engine is in the load region C. If the answer to this question is affirmative (Yes), it is determined at a step S73 that the engine is in the load region C, followed by the program returning to the FIG. 7 program.

On the other hand, if the answer to the question of the step S72 is negative (NO), it is determined at a step S74 that the engine is in the load region D, followed by the program returning to the FIG. 7 program.

Figure 11:
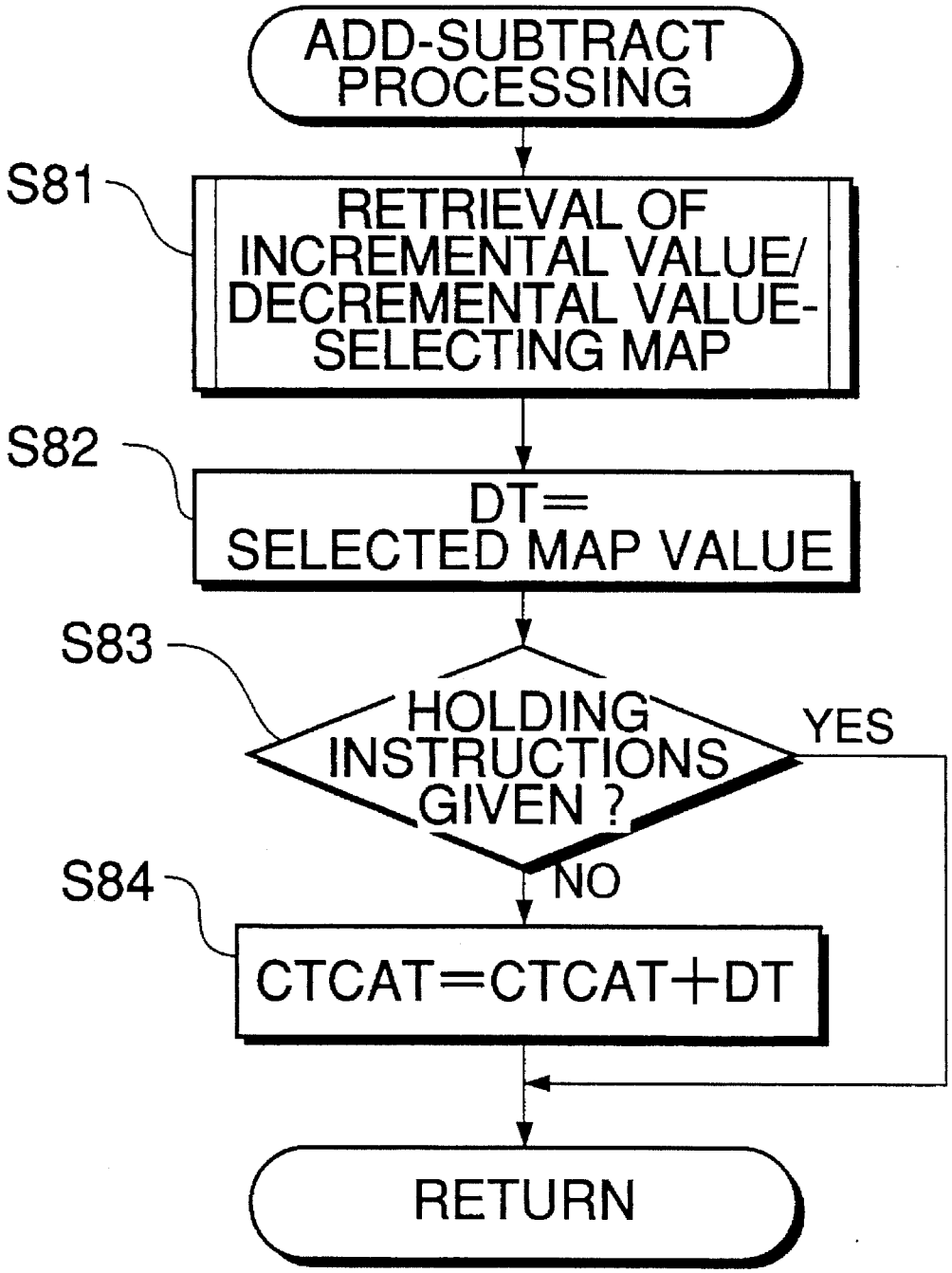
FIG. 11 is a flowchart showing a subroutine for an add-subtract processing forming part of the FIG. 7 routine.

FIG. 11 shows details of the add-subtract processing routine executed at the step S44 in FIG. 7.

At a step S81, an incremental value/decremental value-selecting map is retrieved to calculate an incremental value/decremental value DT.

The incremental value/decremental value-selecting map is set, e.g. as shown in FIG. 12, such that predetermined decremental values, incremental values, and holding instructions are provided correspondingly to present load regions A to D, and immediately preceding estimated temperature regions I (e.g. lower than 400° C.), II (e.g. 400°to 500° C.), III (e.g. higher than 500° C.). The incremental value/decremental value DT is determined by retrieval of the incremental value/decremental value-selecting map.

Then, at the following step S82, the map value read retrieved from the incremental value/decremental value-selecting map is set to the incremental value/decremental value DT, and then at a step S83, it is determined whether or not the set incremental value/decremental value DT gives the holding instructions. If the answer to this question is affirmative (YES), the program returns to the FIG. 7, whereas if the answer is negative (NO), the incremental value/decremental value DT is added to the count CTCAT of the catalyst temperature-estimating counter to update the same, followed by the program returning to the FIG. 7 program.

Figure 13:
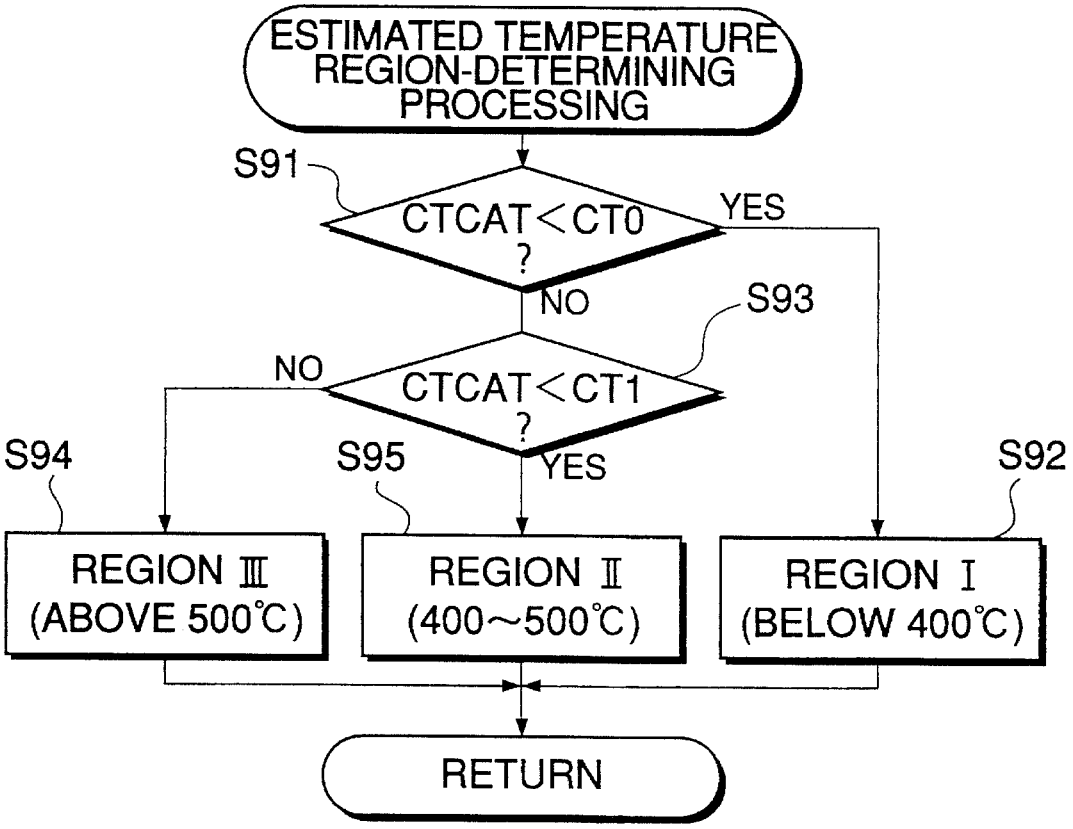
FIG. 13 is a flowchart showing a subroutine for an estimated temperature region-determining processing forming part of the FIG. 7 routine.

FIG. 13 shows details of the estimated temperature region-determining routine executed at the step S45 in FIG. 7.

At a step S91, it is determined whether or not the count CTCAT of the catalyst temperature-estimating counter is smaller than a first predetermined value CT0 (e.g. corresponding to an estimated temperature value of 400° C.). If the answer to this question is affirmative (YES), i.e. if the aforementioned executing condition is not fulfilled so that the count CTCAT is set to "0", for example, it is determined at a step S92 that the estimated catalyst bed temperature falls in the region I (e.g. lower than 400° C.), followed by terminating the program.

On the other hand, if the answer to the question of the step S91 is negative (NO), the program proceeds to a step S93, where it is determined whether or not the count CTCAT of the estimated temperature counter is smaller than a second predetermined value CT1 (e.g. corresponding to an estimated temperature value of 500° C.). If the answer to this question is affirmative (YES), i.e. if the add-subtract processing effected by the use of the value DT in the immediately preceding loop (see FIG. 11) gives a value larger than the first predetermined value CT0 but smaller than the second predetermined value CT1, it is determined at a step S95 that the estimated catalyst bed temperature falls in the region II (e.g. in a range of 400°to 500° C.), followed by terminating the program. If the answer to the question of the step S93 is negative (NO), i.e. if the count CTCAT of the catalyst temperature-estimating counter exceeds the second predetermined value CT1, it is determined at a step S94 that the estimated catalyst bed temperature falls in the region III (e.g. lower than 500° C.), followed by terminating the program.

Then, one of the estimated catalyst bed temperature regions I to III is used in setting the count CTCAT of the estimated temperature counter (see FIG. 11) in the following loop. That is, the catalyst bed temperature TCAT is estimated based on the count CTCAT or cumulative value of the catalyst temperature-estimating counter.

FIG. 14 shows an essential part of an abnormality-detecting routine according to a third embodiment of the invention. This embodiment is distinguished from the second embodiment described above in that the catalyst temperature-estimating counter for estimating the catalyst bed temperature TCAT of the catalytic converter 14, based on which the period during which abnormality detection should be deferred, is replaced by an exhaust gas temperature-estimating counter for estimating the temperature TEX of exhaust gases emitted from the engine, based on operating conditions of the engine. In this embodiment, the time period during which the abnormality determination should be deferred is determined based on the count CTTEX of the exhaust gas temperature-estimating counter. Except for this, the abnormality-detecting routine according to the third embodiment of the invention is identical to the abnormality-detecting routine according to the second embodiment, and the abnormality-detecting routine of the present embodiment is different from the abnormality-detecting routine of the second embodiment only in that the step S31 for determining whether the count CTCAT of the catalyst temperature-estimating counter exceeds a predetermined value CTTEH is replaced by a step S101 for determining whether or not the count CTTEX of the exhaust gas temperature-estimating counter exceeds a predetermined value CTTEH. If the answer to the question of the step S101 is negative (NO), it is judged that a sufficiently long time period has not elapsed after the start of the engine, and then the abnormality determination is deferred at the step S22, whereas if the answer is affirmative (YES), i.e. if CTTEX >CTTEH, this means that in spite of the fact that the downstream O2 sensor 17 has been properly warmed up because of the lapse of the sufficiently long time period after the start of the engine, the amount of change in the output voltage in the downstream O2 sensor 17 is abnormally small, and hence it is determined that the downstream O2 sensor 17 is abnormal. The method of estimating the exhaust gas temperature TEX or calculating the count CTTEX of the exhaust gas temperature-estimating counter is similar to the method of estimating the catalyst bed temperature or calculating the count CTCAT of the catalyst temperature-estimating counter, employed in the second embodiment described above, and hence description thereof is omitted.

Figure 15:
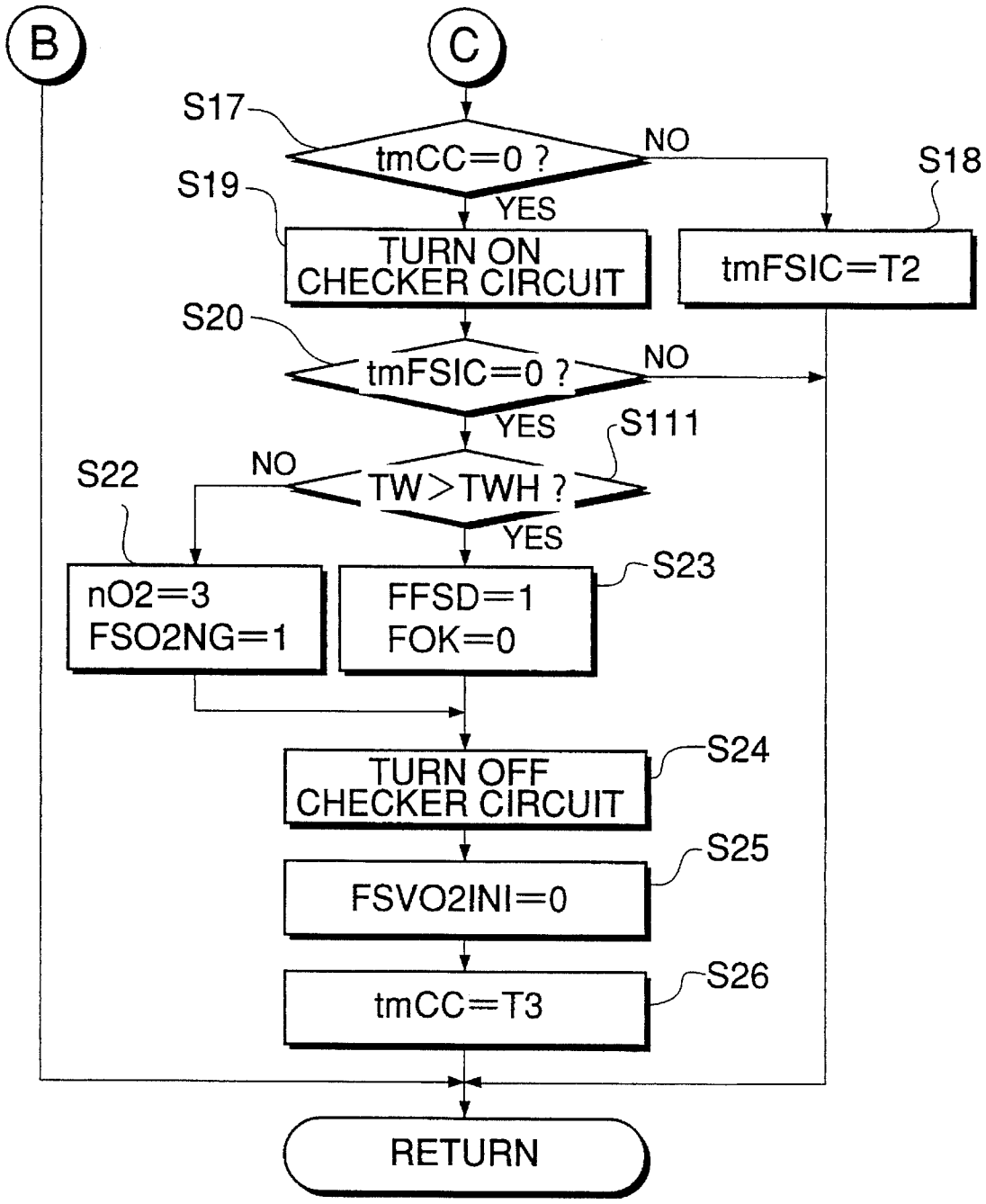
FIG. 15 is a flowchart showing an essential part of an abnormality-detecting routine for detecting abnormality of the exhaust gas component concentration sensor, according to a fourth embodiment of the invention.
Figure 16:
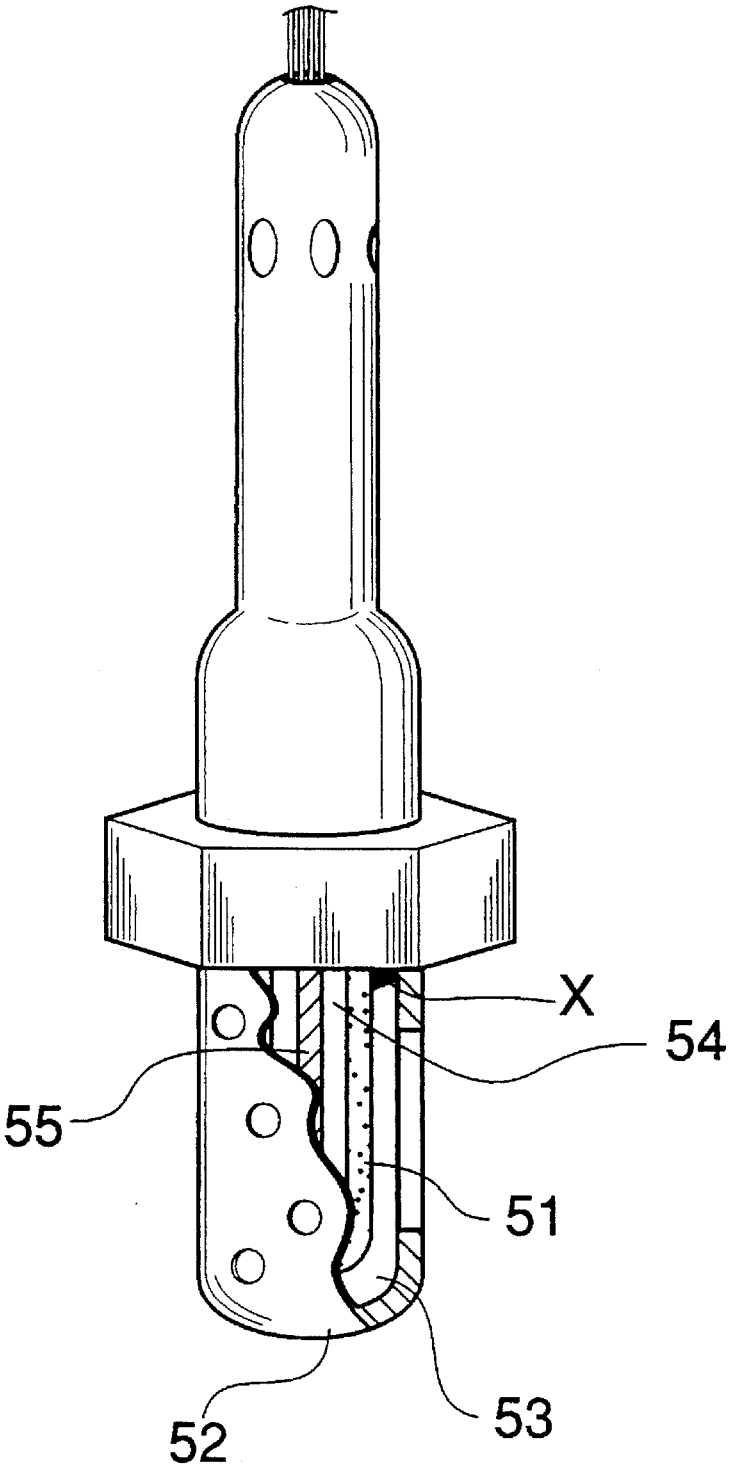
FIG. 16 is a perspective view, partly broken, of an 02 sensor, which is useful in explaining a problem with the prior art to be solved by the present invention.

FIG. 15 shows an essential part of an abnormality-detecting routine according to a fourth embodiment of the invention. This embodiment is based on the fact that a warmed-up state of the O2 sensor 17 can be determined from the engine coolant temperature TW as well. Therefore, this embodiment is distinguished from the second embodiment only in that the catalyst temperature-estimating counter is replaced by an engine coolant temperature sensor 10. The abnormality-detecting routine of the present embodiment is distinguished from that of the second embodiment in a step S111 of FIG. 15 for determining whether or not the engine coolant temperature TW is higher than a predetermined value TWH. If the answer to the question of the step S111 is negative (NO), it is judged that the engine has not been warmed up, and then the abnormality determination is deferred at the step S22, whereas if the answer is affirmative (YES), i.e. if TW >TWH, this means that in spite of the fact that the downstream O2 sensor 17 has been warmed up, which is determined from the engine coolant temperature TW, the amount of change in the output voltage in the downstream O2 sensor 17 is abnormally small, and hence it is determined at the step S23 that the downstream 02 sensor 17 is abnormal.

What is claimed is:

1. In an abnormality-detecting device for an exhaust gas component concentration sensor of an internal combustion engine, said engine having an exhaust system in which is arranged said exhaust gas component concentration sensor for detecting concentration of a component of exhaust gases emitted from said engine, said abnormality-detecting device including abnormality-detecting means for detecting abnormality of said exhaust gas component concentration sensor, based on an amount of change in an output from said exhaust gas component concentration sensor exhibited when a predetermined voltage is applied thereto, the improvement wherein said abnormality-detecting means comprises normality-determining means for determining that said exhaust gas component concentration sensor is functioning normally when said amount of change in said output from said exhaust gas component concentration sensor exceeds a predetermined value, and abnormality determination-deferring means for deferring determination of abnormality of said exhaust gas component concentration sensor based on said amount of change in said output from said exhaust gas component concentration sensor, when said amount of change in said output assumes a value below said predetermined value before said engine reaches a predetermined operating condition after said engine is started.

2. An abnormality-detecting device for an exhaust gas component concentration sensor according to claim 1, wherein said predetermined operating condition of said engine at least includes a condition in which condensate of water formed within said exhaust gas component concentration sensor has evaporated.

3. An abnormality-detecting device for an exhaust gas component concentration sensor according to claim 2, wherein said abnormality determination-deferring means regards said exhaust gas component concentration sensor as inactive so long as said determination of abnormality of said exhaust gas component concentration sensor is deferred.

4. An abnormality-detecting device for an exhaust gas component concentration sensor according to claim 3, including measuring means for measuring a time period elapsed after said engine is started, and operating condition-determining means for determining whether said engine has reached said predetermined operating condition, based on said time period measured by said measuring means.

5. An abnormality-detecting device for an exhaust gas component concentration sensor according to claim 4, wherein said predetermined operating condition of said engine is an operating condition in which said time period elapsed after said engine is started has reached a predetermined time period.

6. An abnormality-detecting device for an exhaust gas component concentration sensor according to claim 3, wherein said engine includes a catalytic converter arranged in said exhaust system, and wherein said abnormality-detecting device includes operating condition-determining means for determining whether said engine has reached said predetermined operating condition, based on a catalyst bed temperature of said catalytic converter.

7. An abnormality-detecting device for an exhaust gas component concentration sensor according to claim 6, wherein said predetermined operating condition of said engine is an operating condition in which said catalyst bed temperature is above a predetermined value.

8. An abnormality-detecting device for an exhaust gas component concentration sensor according to claim 6, including engine speed-detecting means for detecting rotational speed of said engine, load-detecting means for detecting load on said engine, load region-determining means for determining a load region in which said engine is operating, based on results of detection by said engine speed-detecting means and said load-detecting means, and catalyst bed temperature-estimating means for estimating said catalyst bed temperature of said catalytic converter, depending on said load region determined by said load region-determining means.

9. An abnormality-detecting device for an exhaust gas component concentration sensor according to claim 8, wherein said catalyst bed temperature-estimating means accumulates a value dependent on said load region determined by said load region-determining means, and estimates said catalyst bed temperature of said catalytic converter, based on the accumulated value.

10. An abnormality-detecting device for an exhaust gas component concentration sensor according to claim 3, including operating condition-determining means for determining whether said engine has reached said predetermined operating condition, based on an exhaust gas temperature of said engine.

11. An abnormality-detecting device for an exhaust gas component concentration sensor according to claim 10, wherein said predetermined operating condition of said engine is an operating condition in which said exhaust gas temperature is above a predetermined value.

12. An abnormality-detecting device for an exhaust gas component concentration sensor according to claim 10, including engine speed-detecting means for detecting rotational speed of said engine, load-detecting means for detecting load on said engine, load region-determining means for determining a load region in which said engine is operating, based on results of detection by said engine speed-detecting means and said load-detecting means, and exhaust gas temperature-estimating means for estimating said exhaust gas temperature, depending on said load region determined by said load region-determining means.

13. An abnormality-detecting device for an exhaust gas component concentration sensor according to claim 12, wherein said exhaust gas temperature-estimating means accumulates a value dependent on said load region determined by said load region-determining means, and estimates said exhaust gas temperature, based on the accumulated value.

14. An abnormality-detecting device for an exhaust gas component concentration sensor according to claim 3, including coolant temperature-detecting means for detecting a coolant temperature of said engine, and operating condition-determining means for determining whether said engine has reached said predetermined operating condition, based on said coolant temperature of said engine detected by said coolant temperature-detecting means.

15. An abnormality-detecting device for an exhaust, gas component concentration sensor according to claim 14, wherein said predetermined operating condition is an operating condition in which said coolant temperature is above a predetermined value.

16. An abnormality-detecting device for an exhaust gas component concentration sensor according to claim 1, including measuring means for measuring a time period elapsed after said engine is started, and operating condition-determining means for determining whether said engine has reached said predetermined operating condition, based on said time period measured by said measuring means.

17. An abnormality-detecting device for an exhaust gas component concentration sensor according to claim 16, wherein said predetermined operating condition of said engine is an operating condition in which said time period elapsed after said engine is started has reached a predetermined time period.

18. An abnormality-detecting device for an exhaust gas component concentration sensor according to claim 1, wherein said engine includes a catalytic converter arranged in said exhaust system, and wherein said abnormality-detecting device includes operating condition-determining means for determining whether said engine has reached said predetermined operating condition, based on a catalyst bed temperature of said catalytic converter.

19. An abnormality-detecting device for an exhaust gas component concentration sensor according to claim 18, wherein said predetermined operating condition of said engine is an operating condition in which said catalyst bed temperature is above a predetermined value.

20. An abnormality-detecting device for an exhaust gas component concentration sensor according to claim 18, including engine speed-detecting means for detecting rotational speed of said engine, load-detecting means for detecting load on said engine, load region-determining means for determining a load region in which said engine is operating, based on results of detection by said engine speed-detecting means and said load-detecting means, and catalyst bed temperature-estimating means for estimating said catalyst bed temperature of said catalytic converter, depending on said load region determined by said load region-determining means.

21. An abnormality-detecting device for an exhaust gas component concentration sensor according to claim 20, wherein said catalyst bed temperature-estimating means accumulates a value dependent on said load region determined by said load region-determining means, and estimates said catalyst bed temperature of said catalytic converter, based on the accumulated value.

22. An abnormality-detecting device for an exhaust gas component concentration sensor according to claim 1, including operating condition-determining means for determining whether said engine has reached said predetermined operating condition, based on an exhaust gas temperature of said engine.

23. An abnormality-detecting device for an exhaust gas component concentration sensor according to claim 22, wherein said predetermined operating condition of said engine is an operating condition in which said exhaust gas temperature is above a predetermined value.

24. An abnormality-detecting device for an exhaust gas component concentration sensor according to claim 22, including engine speed-detecting means for detecting rotational speed of said engine, load-detecting means for detecting load on said engine, load region-determining means for determining a load region in which said engine is operating, based on results of detection by said engine speed-detecting means and said load-detecting means, and exhaust gas temperature-estimating means for estimating said exhaust gas temperature, depending on said load region determined by said load region-determining means.

25. An abnormality-detecting device for an exhaust gas component concentration sensor according to claim 24, wherein said exhaust gas temperature-estimating means accumulates a value dependent on said load region determined by said load region-determining means, and estimates said exhaust gas temperature, based on the accumulated value.

26. An abnormality-detecting device for an exhaust gas component concentration sensor according to claim 1, including coolant temperature-detecting means for detecting a coolant temperature of said engine, and operating condition-determining means for determining whether said engine has reached said predetermined operating condition, based on said coolant temperature of said engine detected by said coolant temperature-detecting means.

27. An abnormality-detecting device for an exhaust gas component concentration sensor according to claim 26, wherein said predetermined operating condition is an operating condition in which said coolant temperature is above a predetermined value.

* * * * *